United States Patent [19]

Gurkin

[11] Patent Number: 4,732,279

[45] Date of Patent: Mar. 22, 1988

[54] CONVERTIBLE LETTER/FLAT MAIL SORTING CASE

[76] Inventor: David E. Gurkin, 3035 "B" Guildford, Boca Raton, Fla. 33434

[21] Appl. No.: 916,803

[22] Filed: Oct. 8, 1986

[51] Int. Cl.[4] ..... B07C 7/04

[52] U.S. Cl. ..... 209/702; 211/10; 211/184; 209/900

[58] Field of Search ..... 209/546, 702, 900, 942; 232/24–26; 206/449, 555; 312/183; 211/10, 184

[56] References Cited

U.S. PATENT DOCUMENTS

| | | | |
|---|---|---|---|
| 721,950 | 3/1903 | Heald | 211/10 X |
| 1,217,973 | 3/1917 | Mann | 211/10 X |
| 1,255,940 | 2/1918 | Smith | 211/10 X |
| 1,593,326 | 7/1926 | Bourn | 211/10 X |
| 1,698,946 | 1/1929 | Edgren | 211/184 X |
| 2,570,636 | 10/1951 | Bolling | 211/10 X |

*Primary Examiner*—Sherman D. Basinger
*Attorney, Agent, or Firm*—Ernest H. Schmidt

[57] ABSTRACT

A mail sorting case having a plurality of shelves, each of which is divided into a plurality of letter receiving slots defined by vertically extending, spaced, parallel partitions swingably supported from above, includes mechanism to swingingly withdraw the partitions to substantially horizontal position against the underside of the top panel of their respective shelves to provide for the sorting of flat mail by placement on the bottom panel of the respective shelves. Mechanism is also included for simultaneously erecting flats divider partitions swingingly supported against the bottom panel of the shelves and normally lying flat thereagainst.

8 Claims, 14 Drawing Figures

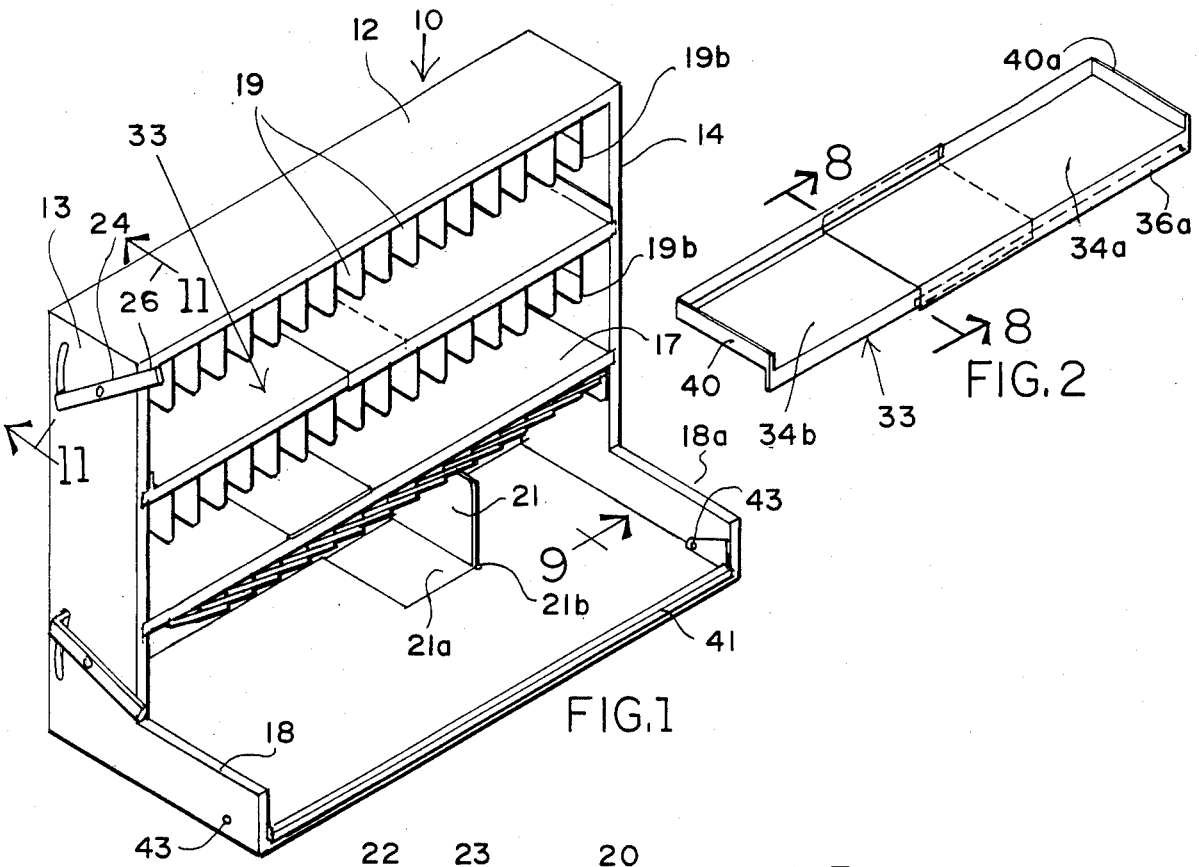
FIG. 1
FIG. 2
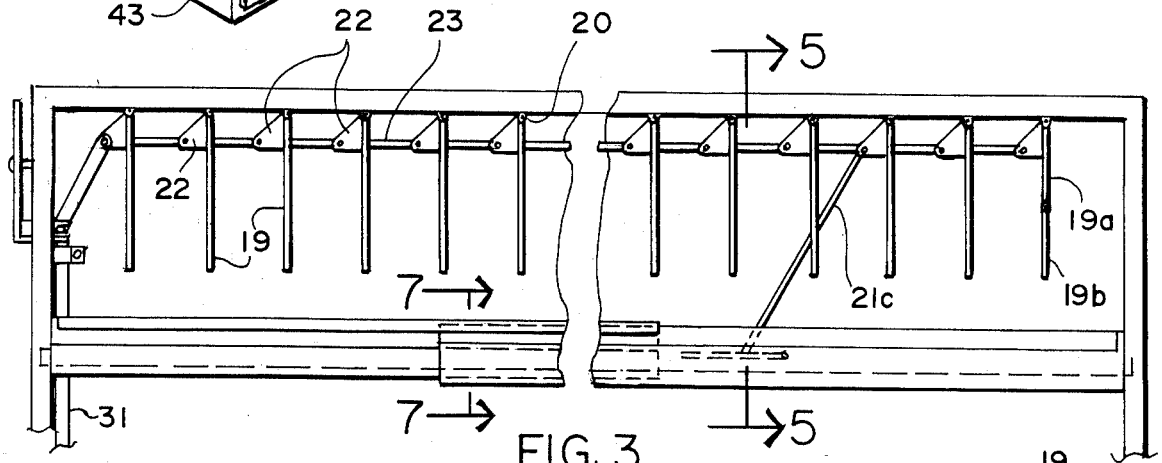
FIG. 3
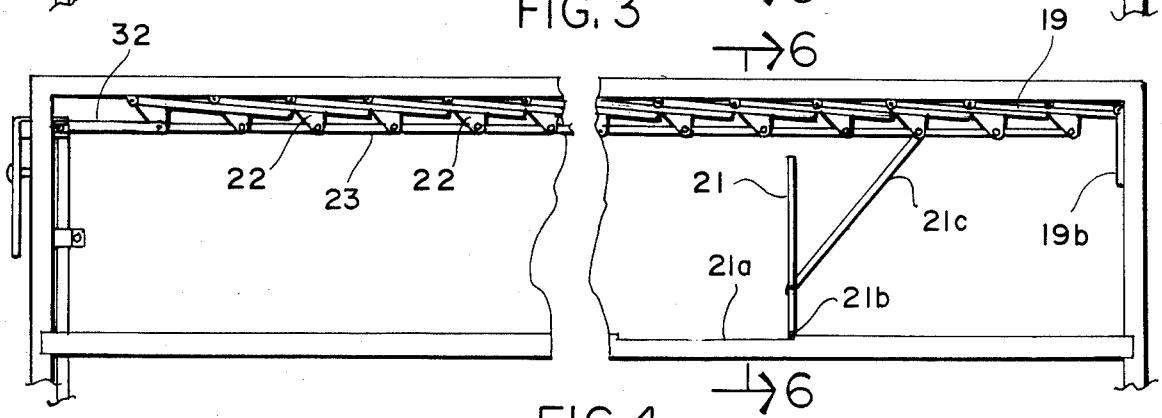
FIG. 4

CONVERTIBLE LETTER/FLAT MAIL SORTING CASE

This invention relates to the sorting for local delivery of mail in post offices, and is directed particularly to improvements in the standard sorting cases heretofore used by postal workers, usually postal route carriers, in preparing mail for delivery.

Letter carrier mail sorting cases heretofore used have consisted of bookcase-like units, usually having six shelves, fitted with vertical partitions along each shelf, usually forty partitions per shelf, for the insertion of letter mail in order of delivery to the addressee. After all the letter mail for a particular delivery route is thus sorted, it is extracted in sequential order as separated and tied into convenient bundles for delivery. This is repeated until 48 inches of running mail per shelf is removed. As only three to four inches of mail can conveniently be removed without spilling, a minimum of 10 to 15 withdrawals per shelf is necessary. Moreover, since the mail transfer from shelf to hand in this manner results in uneven letter edges, in order for the carrier to insure a compact bundle which will not come apart in transit it is necessary for him to tamp it a number of times before applying the bundling strap or band. To accommodate for the sorting of flats, that is, flat mail of larger than letter size, a portion of one or more shelves of the sorting case has a number of separator partitions omitted to provide enough space for sorting and horizontal support in sequence for delivery of the flats.

Alternatively, a so called "wing" case, usually one-half size or fully equal in dimension to the main case, gives sufficient open shelf space for supporting cased flats, is attached to one side of the main case as may be needed.

It is, accordingly, the principal object of my invention to obviate the above-mentioned and other deficiencies of presently devised mail sorting cases by doubling the casing area by the provision of a convertible letter/-flat combination sorting case having a plurality of sorting shelves, which, selectively, can be converted from letter partition condition (for sorting letters) to flats supporting condition (for sorting larger, flat mail) simply by actuation of a manual conversion lever.

It is another object of the invention to provide a novel and improved combination letter and flat mail sorting case of the character described having compressor trays selectively receivable on each of the letter sorting shelves for extracting and compressing together sorted letters in readiness for bundling or strapping with a minimum of handling.

Another object is to provide a combination letter and flat mail sorting case of the character described that requires less floor space in installation and use than sorting cases heretofore used in the handling of like quantities of mail for delivery.

Still another object of the invention is to provide a combination letter and flat mail sorting case of the above nature including reversible label bars running along the tops of each shelf and identifying each of the corresponding delivery address slots for letter mail on one side and flat sorting compartments on the other side for selective presentation to the mail sorter, depending upon whether he is sorting letter mail or flat mail, the label bars being simultaneously actuated upon actuation of the conversion lever.

Other objects, features and advantages of the invention will be apparent from the following description when read with reference to the accompanying drawings.

In the drawings, wherein like reference numerals denote corresponding parts throughout the several views:

FIG. 1 is an oblique view, as seen from the front, of a mail sorting case embodying the invention;

FIG. 2 is an oblique view of one of the shelf-supported letter mail compressor trays, shown separately;

FIG. 3 is a partial front elevational view illustrating the upper shelf with the letter separators in downwardly-extending position;

FIG. 4 is an elevational view as in FIG. 3, showing the letter separators in upwardly-withdrawn position;

Figure 5:
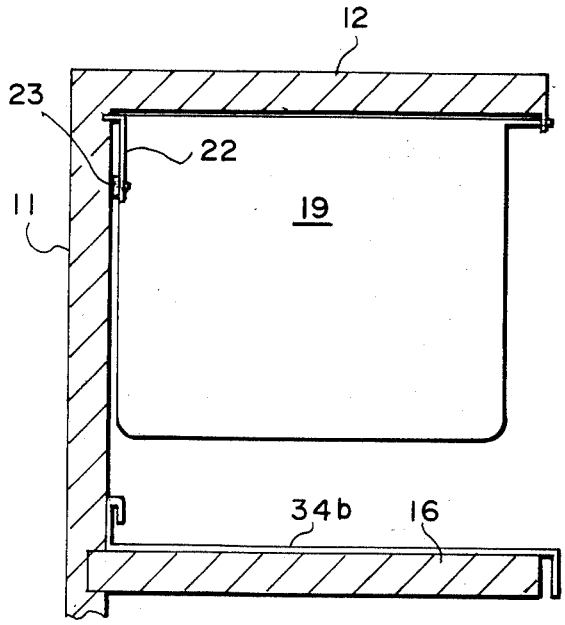
FIG. 5 is a vertical cross-sectional view, taken along the plane indicated at 5—5 of FIG. 3 in the direction of the arrows.
Figure 6:
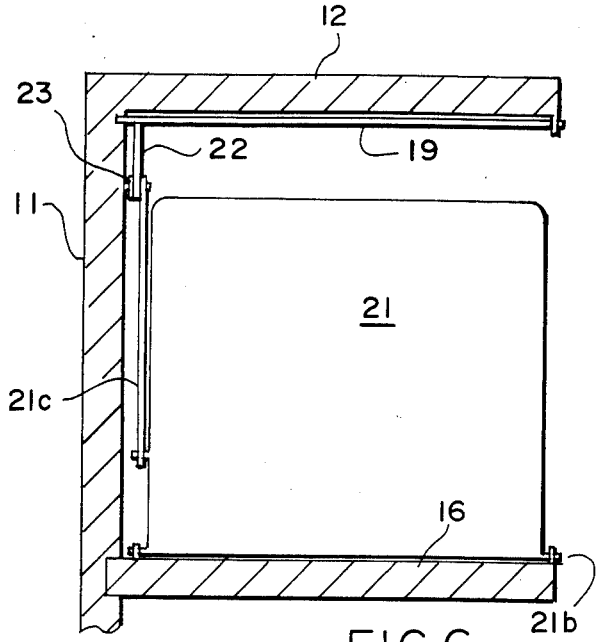
FIG. 6 is a vertical cross-sectional view, taken along the plane indicated at 6—6 of FIG. 4 in the direction of the arrows.
Figure 7:
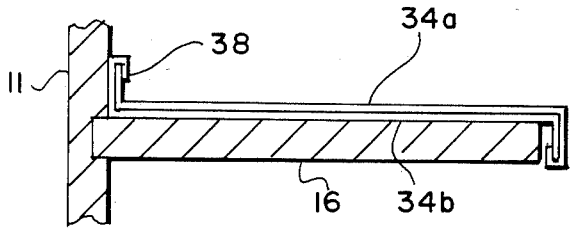
FIG. 7 is a partial cross-sectional view, taken along the plane indicated at 7—7 of FIG. 3 in the direction of the arrows.
Figure 8:
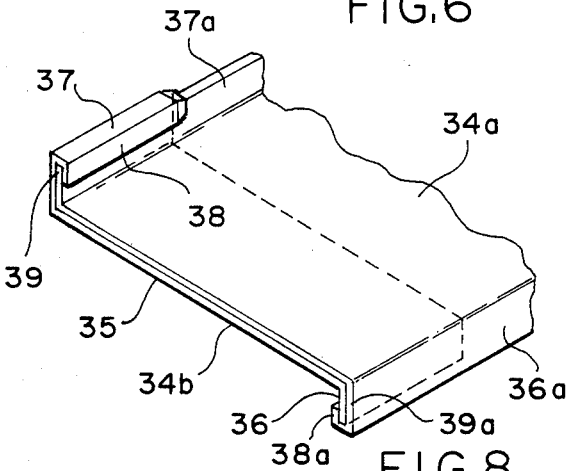
FIG. 8 is a transverse cross-sectional view, taken along the line indicated at 8—8 of FIG. 2 and illustrating the sliding interfit between the two sections of one of the letter mail compressor trays.

Referring now in detail to the drawings, reference numeral 10 designates, generally, an improved letter carrier mail sorting case embodying my invention. As illustrated in FIGS. 1 through 9, the mail sorting case is rectangular in shape, having a back panel 11, a top wall 12, sidewalls 13 and 14 and a bottom wall or base 15. Upper and lower intermediate shelf members 16 and 17 (which may be adjustably fixed at different levels) divide the mail sorting case 10 into upper, intermediate and lower case sections for letter and flat mail sorting, selectively, in the manner hereinafter described. The bottom wall or base 15 extends forwardly of the top wall 12, the side walls 13, 14 and the intermediate shelf members 16 and 17, which are all substantially of the same front-to-back width. Lower end portions 18 and **18*a* of the side walls 13 and 14 extend forwardly to be co-extensive with the bottom wall or base 15**, and are secured thereto to provide added strength and rigidity, and for supporting sorted letter mail in trays, as is hereinafter described.

Each of the upper, intermediate and lower case sorting sections is provided with a plurality of equidistantly-spaced separators 19, which may be fabricated of sheet aluminum for example, and which are hinged for simultaneous sideward pivotal motion, as by hinges 20, against the undersides of their respective case section top walls. As best illustrated in FIG. 3, the letter mail separators 19 normally hang vertically down and extend somewhat short of the bottom of their case sections, specifically to allow room for the use of trays, if so desired, but can be moved, selectively, to the upwardly-withdrawn position, as illustrated in FIG. 4.

It is to be understood that when any one of the case sorting sections has its separators 19 in downwardly-extending position, that section can be used for the hand sorting of carrier mail in a manner hereinafter more particularly described, whereas when the separators are moved to the upwardly-withdrawn position (FIG. 4), the corresponding shelf-space directly below can be used for the sorting of so-called "flats", i.e. magazines, extra large envelopes, newspapers and the like. To this end, as illustrated in FIG. 4, and as hereinbelow more fully described, mechanism is provided for raising a flats separator 21 from the shelf bottom when the associated letter separators 19 of the same case section are moved to upwardly-withdrawn position. Thus, any one or all of the upper, intermediate and lower case sorting sections can be used, selectively or simultaneously for the sorting for delivery of either letter mail or flats.

Since the control mechanism for the letter mail and flats mail separators is the same for each sorting case section, only that mechanism of the upper sorting case section will now be described in detail, by way of example. As illustrated in FIGS. 1, 3 and 5, each of the separators 19 is provided, at the upper end and at the inside, near the back inside wall of the case back panel 11, with a rectangularly-bent, sidewardly-extending triangular arm portion 22, which is pivotally linked at its lower, outer corner to the next adjacent separator 19 as by a common link bar 23.

A pivot bar lever 24 is pivotally secured as by pivot screw 25 against the left-hand outside of the sorting case (see FIGS. 11 through 14). One end of the pivot lever bar projects forwardly of the sorting case to serve as a manual actuation handle 26. The other end thereof has a right-angularly bent portion 27 which extends through an arcuate slot 28 in the associated side of the case near the rear. Right-angularly bent portion 27 is bifurcated to provide a horizontally-extending slot 29, captured within which is a pivot pin 30. The pivot pin 30 is affixed to and extends perpendicularly outwardly of the upper end of a flat slide bar 31, which serves to actuate the letter separators of the intermediate sorting case shelf or section by the same linkage mechanism now to be described. Swingably supported on the pivot pin 30 between the upper end of the flat slide bar 31 and the right-angularly bent portion 27 on the pivot bar lever 24, is one end of a flat link bar 32. The other end of the flat link bar 32 is pivotally linked to the common link bar 23 at the outer corner of the triangular arm portion 22 of the first, left-most separator 19. In operation, it will be understood, with reference particularly to FIGS. 11 and 12, that when the pivot bar lever 24 is moved from its upper position as illustrated by the full-line representation thereof in FIGS. 11, 12 and 13, the right-angularly bent portion 27 thereof serves to maintain link bar 32 in its downwardly-inclined position, whereat the separators 19 extend vertically downward for letter separation. When the pivot bar lever 24 is moved by handle 25 to its downward-most position at the front, the right-angularly bent portion 27 thereof will be moved to the upward-most position, as illustrated by the broken-line representation thereof in FIG. 11, and flat link bar 32 will have moved upwardly and sidewardly towards the opposite side of the case, to simultaneously move the common link bar 23 to the right and thereby elevate or withdraw all of the separators 19 in unison. In this connection, it will be understood that the fixed hinges of the separators 19, together with their offset pivotal inter-linking by the common link bar 23, serve as a parallel guide mechanism rotating said letter separators from the downwardly-extending position (as illustrated in FIG. 3) to the upwardly-withdrawn position (as illustrated in FIG. 4) as the handle 25 is moved between the full-line and broken-line positions thereof illustrated in FIG. 11.

As referred to above, when the letter separators 19 are moved upwardly to the withdrawn position as illustrated by way of example in FIG. 4, the flats separator 21 is automatically rotated from a shallow seat **21*a* in its associated shelf to upright position, thereby dividing the shelf into shelf sections for separating different groups of flats. To this end, the flats separator 21, which is hinged as by hinge 21*b* along one side of its shallow seat 21*a*, is pivotally interlinked as by flat link 21*c* with the common link bar 23 at an appropriate one of the letter separator triangular arm portions 22 for effecting the desired motion of said flats separator. Thus, as illustrated in FIG. 3, the lower end of the flat link 21*c* will be pivotally journalled, as at 31, to an inner edge portion of the flats separator 21 at a position spaced upwardly of its hinge 21*b* to produce the desired swinging movement to the upright position. Although only one flats separator 21** is illustrated and described along one of the shelves by way of example, it is to be understood that two or three such separators could be arranged along one or more of the case shelves to provide a plurality of flats separator compartments as may be required.

Letter mail compressor trays are provided for use in association with each of the upper, intermediate and lower case sections to aid in the sorting, extracting and strapping of letter mail, as is hereinafter more particularly described. As illustrated in FIG. 2, letter mail compressor tray 33 comprises inner and outer tray sections **34*b*, 34*a* which slidingly interfit in telescoping relation. The inner tray section 34*b*, which will preferably be fabricated of sheet metal, comprises a rectangular shelf bottom 35, a rectangular, downwardly-bent front edge portion or skirt 36, and an upwardly-bent rear flange portion 37. The rear flange portion 37 terminates in a short, inwardly-extending, reversely-bent portion 38 defining a downwardly-open rectangular recess 39. The inner tray section 33 further comprises an upwardly-bent outer end wall portion 40**.

The outer tray section 34 is similar in construction to the inner tray section 33, differing only in that its outer end wall **40*a* is at the opposite end, and in that the front edge portion or skirt 36*a* is provided with a reversely-bent portion 38*a* defining an upwardly-open rectangular recess 39*a* instead of a reversely-bent portion being provided at the end of the rear flange portion 37*a*. (See FIG. 8). With this construction of the letter mail compressor tray, the skirt 36 of the inner tray 33 fits slidingly within the recess 39a of the outer tray section 34a, and the rear flange portion 37a of the outer tray section 34a fits slidingly within the recess 39 of the inner tray section 33**, to provide for relative sliding movement in telescope fashion.

In use of the hereinabove described mail sorting case by a mail carrier in preparing mail for delivery along his particular route, he will first sort his letter sized mail, "casing it", that is, by placing the letters sequentially in the compartments along a selected shelf defined by the depending separators 19. As illustrated in FIGS. 1 and 3, when letter mail is to be sorted, a letter mail compressor tray 33 will normally first be placed on a selected shelf, in fully-expanded position from end to end. In the case shelf or section selected, each letter mail compartment will be assigned a route subdivision in delivery sequence, which can be marked along the letter mail compactor tray skirt portions 36, 36a when in expanded condition. Thus, each tray can be made specific to a particular delivery route, or portion of a delivery route, independently of its use with any particular one of the upper, intermediate or lower case sections. It will be understood that in marking the compressor trays for sorting for a particular delivery route, pressure-sensitive paper strips or the like marked along their length in divisions corresponding to the width between the letter separators 19, and specifying the various streets, apartment buildings, office buildings and the like along the route, provides a simple method of route marking that can easily be changed from time to time as route changes may require.

After the route letter mail has been sorted to completion in any particular case section, the associated tray 33 will be withdrawn sufficiently from its supporting case section shelf to clear the front edges of the associated separators 19, which extend somewhat short of the front edges of the case. At this time, the rear edges of the sorted letters, which will all abut the rear flange portions 37, 37a of the compressor tray, will have been brought forward of the outer vertical edges of the separators 19, to permit sufficient compacting of the route sorted letters for safe handling.

Figure 9:
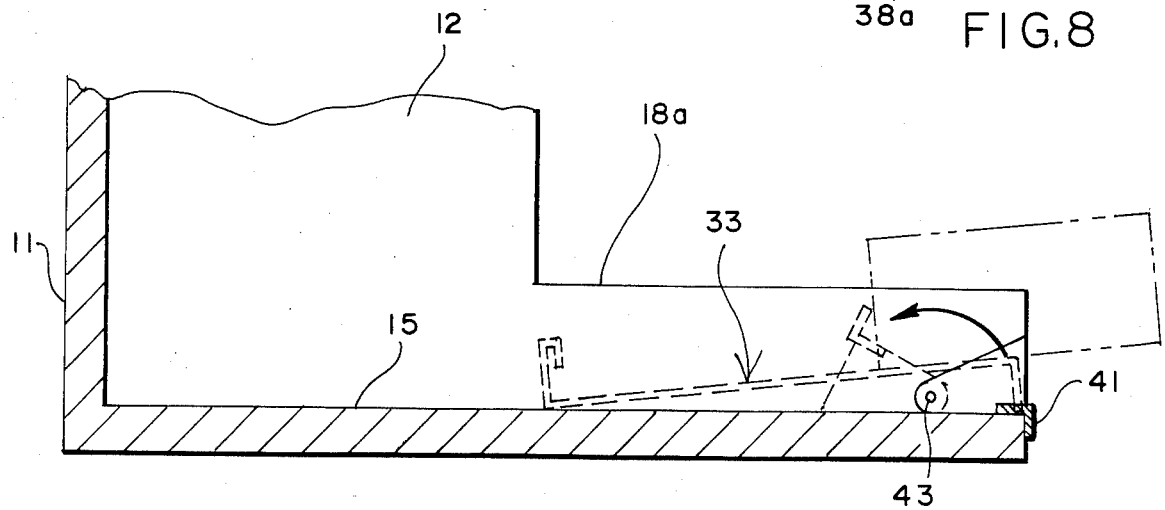
FIG. 9 is a partial vertical cross-sectional view, taken along the line indicated at 9—9 of FIG. 1 and illustrating the mechanism associated with the bottom case shelf for facilitating the strapping of sorted mail.
Figure 10:
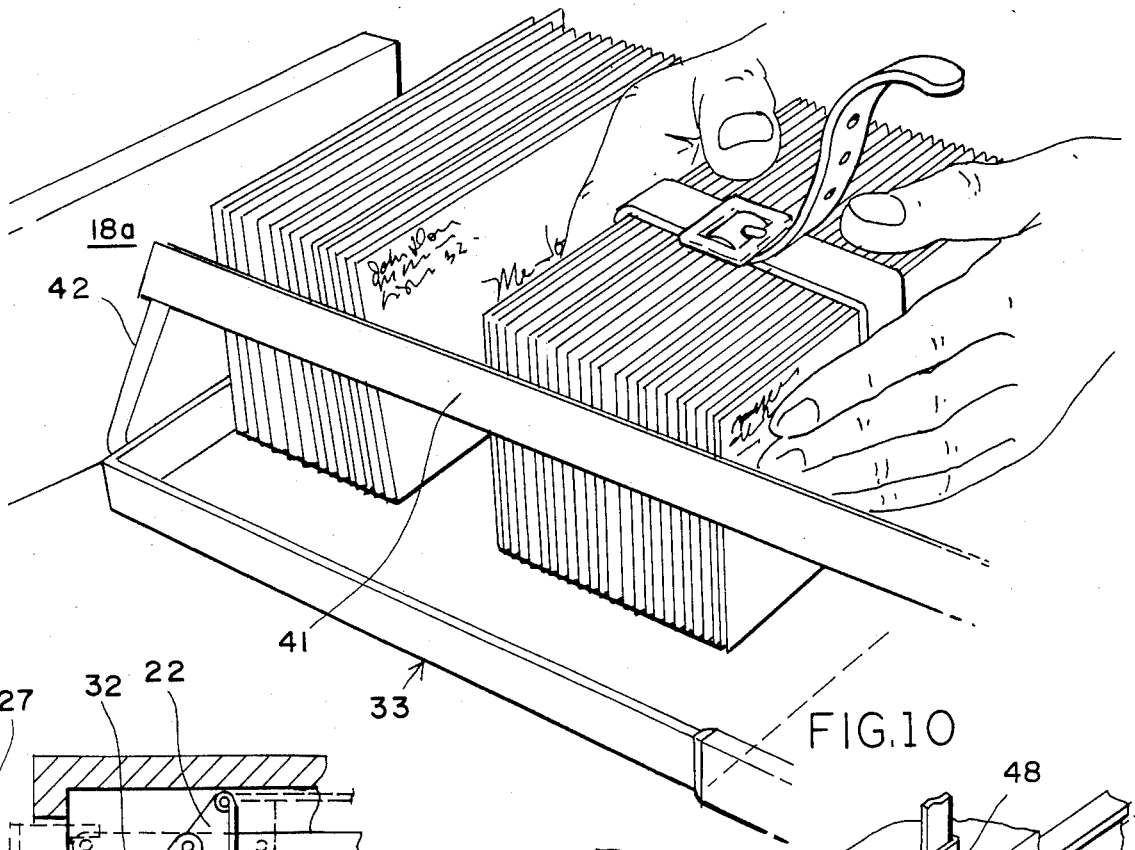
FIG. 10 is an oblique view as seen from behind illustrating how the extracted and compressed mail can conveniently be strapped in bundles without the necessity for tamping, ready for delivery.

To further prepare the sorted letters for delivery, means is provided to facilitate strapping into compact bundles for safe transport prior to being opened for delivery at subdivided areas along the route. To this end, as illustrated in FIGS. 1, 9 and 10, a moveable bar 41, which is right-angular in cross-sectional shape and normally rests over the upper front corner of the bottom wall or base 15, has pivot arms 42 at each end, (only one pivot arm visible in FIG. 1), pivotally journalled at their outer ends to the forwardly-extending sidewall lower end portions 18 and 18a as by pivot pins 43, (See FIG. 9). This pivoted bar mechanism permits upward swinging or rotation of the moveable bar 41 from the full-line representation thereof to the broken-line representation thereof in FIG. 9. When the moveable bar is in its up position, the tray with sorted and compacted letters can be purshed over the base 15 of the case, and under the raised bar 41 so that, as illustrated by the broken-line representation thereof in FIG. 9, the letters L will be pushed partially forwardly of the front edge of the tray to permit free access from underneath to facilitate and simplify strapping of bundles into delivery sequence. In this connection it will be noted that, as illustrated in FIG. 9, the tray is elevated at the front because of its front skirt portions, so that the compacted letters are upwardly inclined from back to front for more stable support for strapping operations.

In preparing the mail for delivery, it will also be understood that for the sorting of flat mail, one or more of the case sections will be assigned to this purpose by moving the associated pivot bar handle 26 to withdraw the separators 19 and elevate the flats separator 21. Although in FIG. 1 only one flats separator 21 for dividing that case section into two compartments is illustrated, it is to be understood that two or more such flats separators, together with control linkage, could be utilized for division into three or more flats receiving compartments. Flats will be sorted for delivery in the same manner, with each compartment assigned to a sub-division of the delivery route. Since letter mail compressor trays are not utilized when a case section is being used for flats, flats route designations can be applied directly to the outer edge of the corresponding case section shelf. After thus sorting flats they can be bundled or strapped for delivery in the usual fashion.

Figure 11:
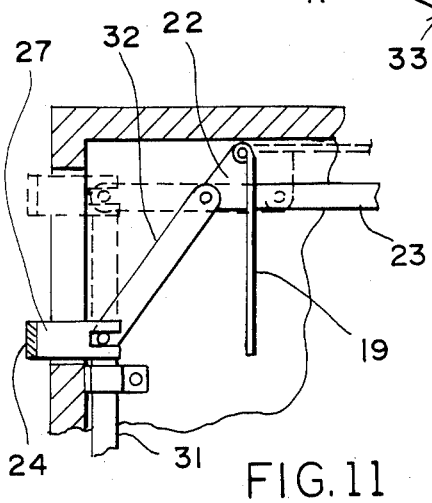
FIG. 11 is a partial cross-sectional view taken along the place indicated at 11—11 of FIG. 1 in the direction of the arrows and showing the mechanical details of the operating mechanism.
Figure 13:
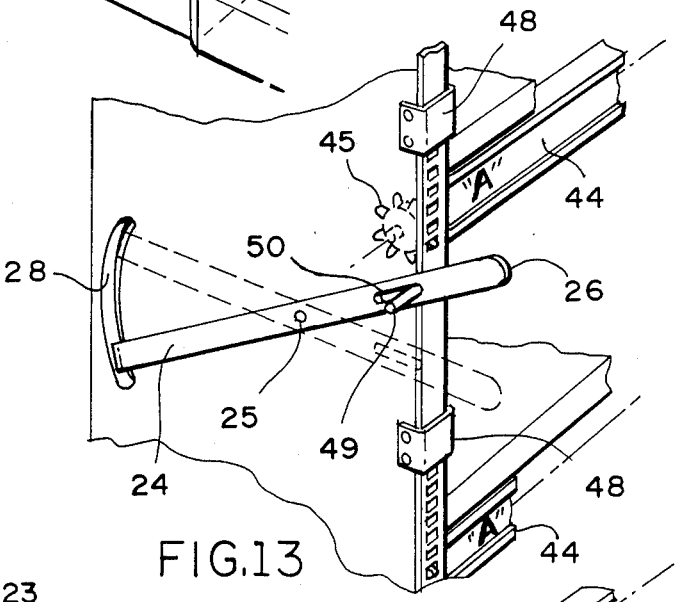
FIG. 13 is a partial oblique view of the mail sorting case as seen from the left side, illustrating the actuating mechanism for the reversible label bars.
Figure 12:
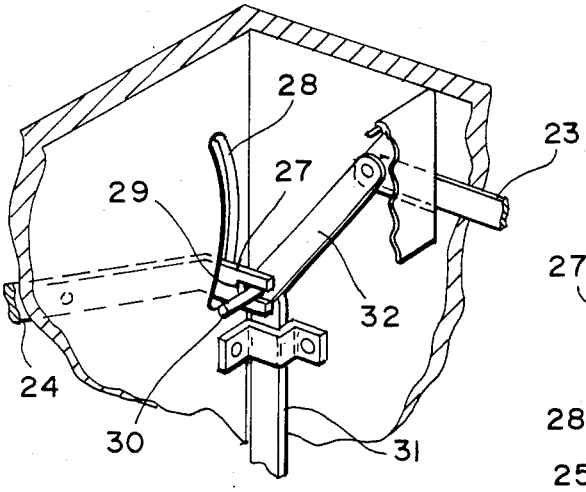
FIG. 12 is an oblique view showing the inner corner of the case as illustrated in FIG. 11 and showing details of the actuating mechanism in perspective.
Figure 14:
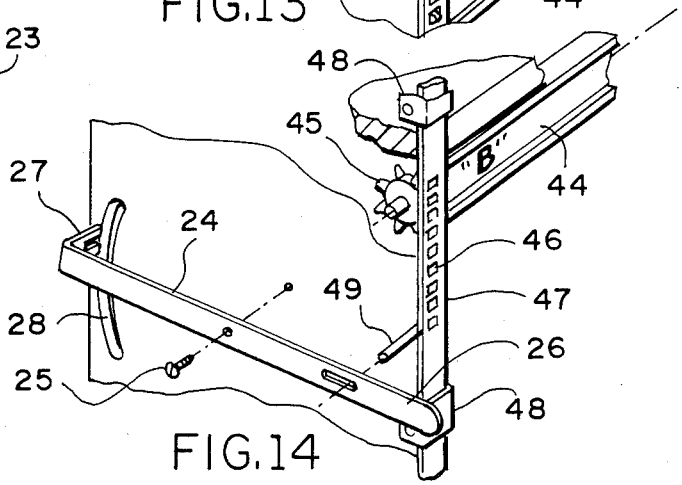
FIG. 14 is a partial view, similar to FIG. 13, showing the label bar in reversed position fro designating the "flats" compartments when the letter separators are withdrawn.

As described above, the fronts of the compressor trays 32, when in expanded condition, can be used for marking delivery route sub-divisions corresponding to the letter slots defined by the separators 19 when in vertically depending positions. Alternatively, two-position, reversible label bars 44 running along the top of each sorting section and identifying each of the corresponding address slots for letter mail on one side, and flats sorting compartments on the other side, are also provided. Thus, as best illustrated in FIGS. 13 and 14, label bar 44 pivotally journalled between the sides of the sorting case along the top of each case section, carry at their left ends a sprocket gear 45. The teeth of the sprocket gear 45 mesh with openings 46 in a rack bar 47 vertically positioned at the left front edge of the sorting case, constrained to vertical or up and down movement with respect thereto by U-shaped metal straps 48. The rack bar 47 has affixed thereto a sidewardly outwardly-projecting pin 49 which extends through a slot 50 in the pivot bar lever 24, so that whenever the separator actuating handle 26 is moved up or down, the rack bar 47 will correspondingly move up or down. The size of the sprocket gear 45 is such that when the handle 26 is moved between uppermost and lowermost positions, the associated label bar 44 will be rotated through 180 circular degrees. Thus, as illustrated in FIGS. 11, 12 and 13, for example, when the handle 26 in its uppermost position, side "A" of the label bar 44 will face to the front. Since, at this position, the separators 19 will be in downwardly dependent position for the sorting of letters, the "A" face can be used to carry route sub-division designations in registration or alignment with the separator compartments or slots to facilitate the sorting of letter mail. When the actuating lever or pivot bar lever handle 26 is moved to downward-most position, to provide for the sorting of flats as described above, the label bar 44 will be rotated to present its opposite side or "B" face, which can be labeled to designate the subdivided delivery spaces for the sorting of flats. As illustrated in FIG. 1 and as described above, the uppermost pivot bar lever handle 26 controls simultaneous actuation of the letter and flats separators, as well as the label bars, of the upper two sorting case sections or compartments, whereas the lower pivot bar lever handle 26 independently actuates, simultaneously, the separators and the label bar associated with lowermost or bottom sorting case sections.

While I have illustrated and described herein only one basic form in which my invention can conveniently be embodied in practice, it is to be understood that this embodiment is presented by way of example only and not in a limiting sense. The invention, in brief, comprises all the embodiments and modifications coming within the scope and spirit of the following claims.

What I claim as new and desire to secure by Letters Patent is:

1. A convertible letter/flat mail sorting case comprising, in combination, a rectangular box-like case member, open at the front, said box-like case member having a top wall, a bottom wall, sidewalls and a back panel, a plurality of flat letter separators hingingly connected in spaced, parallel relation agoainst and along the inside of said top wall and normally depending vertically downwardly therefrom to define a plurality of compartments, open at the front of said box-like case member for the selective reception of letter mail during the sorting thereof, means for simultaneously swinging said letter separator members between said downwardly-depending positions and upwardly retracted, withdrawn positions against the top wall of said rectangular box-like case member, a "flats" separator member hingingly connected to said bottom wall intermediate the length of said bottom wall and moveable, selectively, between substantially horizontal abutting position against the top surface of said bottom wall and perpendicular position between said top and bottom walls for dividing the front opening of said box-like member into compartments, open to the front of said box-like case member, for the selective reception of "flats" mail to be sorted when said letter mail sorting separators are in their upwardly retracted, withdrawn positions.

2. A convertible letter/flat mail sorting case as defined in claim 1 wherein said letter separator members swinging means comprises means operative upon the swinging of said letter separator members into their upwardly retracted withdrawn, positions to move said "flats" separator member from said horizontal position into said perpendicular position.

3. A convertible letter/flat mail sorting case as defined in claim 1 wherein said flat letter separators in their downwardly depending positions define a space between the lower ends thereof and the top surface of said bottom wall, and a letter tray slidingly receiveable within said space from front to back of said box-like member for the support for withdrawal of sorted letter mail.

4. A convertible letter/flat mail sorting case as defined in claim 3 wherein said letter tray comprises a pair of tray sections telescopingly interfitted for relative sliding movement in contraction and expansion, said letter tray further being formed with back and sidewall portions for abutment against marginal lower end portions of sorted letter mail whereby sorted letter mail resting on said letter tray can be withdrawn from said letter separator compartments to permit compressive compaction of said letter tray letters to facilitate bundling of the sorted mail for delivery.

5. A convertible letter/flat mail sorting case as defined in claim 4 wherein the bottom wall of said rectangular boxlike member extends forwardly of said top wall to provide a platform for the support of the letter holding letter tray.

6. A convertible letter/flat mail sorting case as defined in claim 5, said forwardly-extending portion of said bottom wall being provided with short, upstanding sidewall portions, and a retractable pusher bar pivotally arranged between said upstanding sidewall portions and serving to push the back edges of sorted letter mail forward in said letter tray as said letter tray is moved forward along the forwardly-extending bottom wall of said rectangular box-like member, thereby further facilitating the bundling into sub groups of the sorted and compacted letter mail.

7. A convertible letter/flat mail sorting case as defined in claim 1 wherein said box-like case member further comprises a plurality of intermediate walls extending between said side walls to provide a plurality of stacked front openings, each opening of which is defined by top and bottom walls, and each opening of which is provided with letter separators and flats separators as in said first-mentioned front opening.

8. A convertible letter/flat mail sorting case as defined in claim 1 including a reversible label bar running along the front of said top wall and indentifying, on one side, delivery addresses of letter compartments vertically aligned therewith, and on the other side, the delivery addresses of the separated flats spaces aligned therewith, and means controlled by said letter separator members swinging means for reversing the position of said label bar.

* * * * *